US006227962B1

(12) United States Patent
Orendorff

(10) Patent No.: US 6,227,962 B1
(45) Date of Patent: May 8, 2001

(54) VENT COUPLER

(75) Inventor: Gary R. Orendorff, Beaverton, OR (US)

(73) Assignee: Classic Manufacturing NW, LLC, Portland, OR (US)

( * ) Notice: Subject to any disclaimer, the term of this patent is extended or adjusted under 35 U.S.C. 154(b) by 0 days.

(21) Appl. No.: 09/520,774

(22) Filed: Mar. 8, 2000

(51) Int. Cl.[7] ..... F24F 7/00

(52) U.S. Cl. ..... 454/290; 454/289; 454/331; 454/333

(58) Field of Search ..... 454/330, 331, 454/332, 290, 289, 311, 309, 325, 322; 55/480, 493

(56) References Cited

U.S. PATENT DOCUMENTS

| | | | | |
|---|---|---|---|---|
| 637,519 | * | 11/1899 | Mertins | 454/290 |
| 1,151,359 | | 8/1915 | Hood . | |
| 3,391,629 | | 7/1968 | Snell . | |
| 3,740,934 | * | 6/1973 | Shuler | 55/490 |
| 4,171,211 | | 10/1979 | Carter . | |
| 4,334,899 | * | 6/1982 | McConnell | 55/321 |
| 4,520,715 | | 6/1985 | Coomes et al. . | |
| 5,716,270 | | 2/1998 | Chambers . | |
| 5,863,310 | | 1/1999 | Brown et al. . | |
| 5,984,776 | | 11/1999 | Berger . | |
| 6,066,044 | * | 5/2000 | Orendorff | 454/290 |

* cited by examiner

*Primary Examiner*—Harold Joyce
*Assistant Examiner*—Derek Boles
(74) *Attorney, Agent, or Firm*—Klarquist Sparkman Campbell Leigh & Whinston LLP

(57) ABSTRACT

A vent coupler has first and second leg portions and a latch element extending between the leg portions. The coupler may be formed from a single piece of wire and be detachably coupled to a vent damper. The latch element is inserted into a respective air flow slot of a vent cover to engage the vent cover and couple the vent cover to the damper. The coupler may be constructed to permit flexing of the coupler during the insertion process, with the coupler being biased to engage the vent cover when no longer flexed. The vent coupler may snap onto and grip upper and lower edges of an end wall of the damper housing to mount the coupler to the damper. A filter housing may be detachably coupled to the damper housing to support a filter on the opposite side of the damper housing from the vent cover.

23 Claims, 4 Drawing Sheets

30
28
16
34
14
20
12
10
102
101
105
103
54
198
24
32
26
58
50
52
70
72
198
60
66
62
142
124
146
148
100
56
144
68
103
105
130
128
120
101
148
126
144
140
146
162
122
160

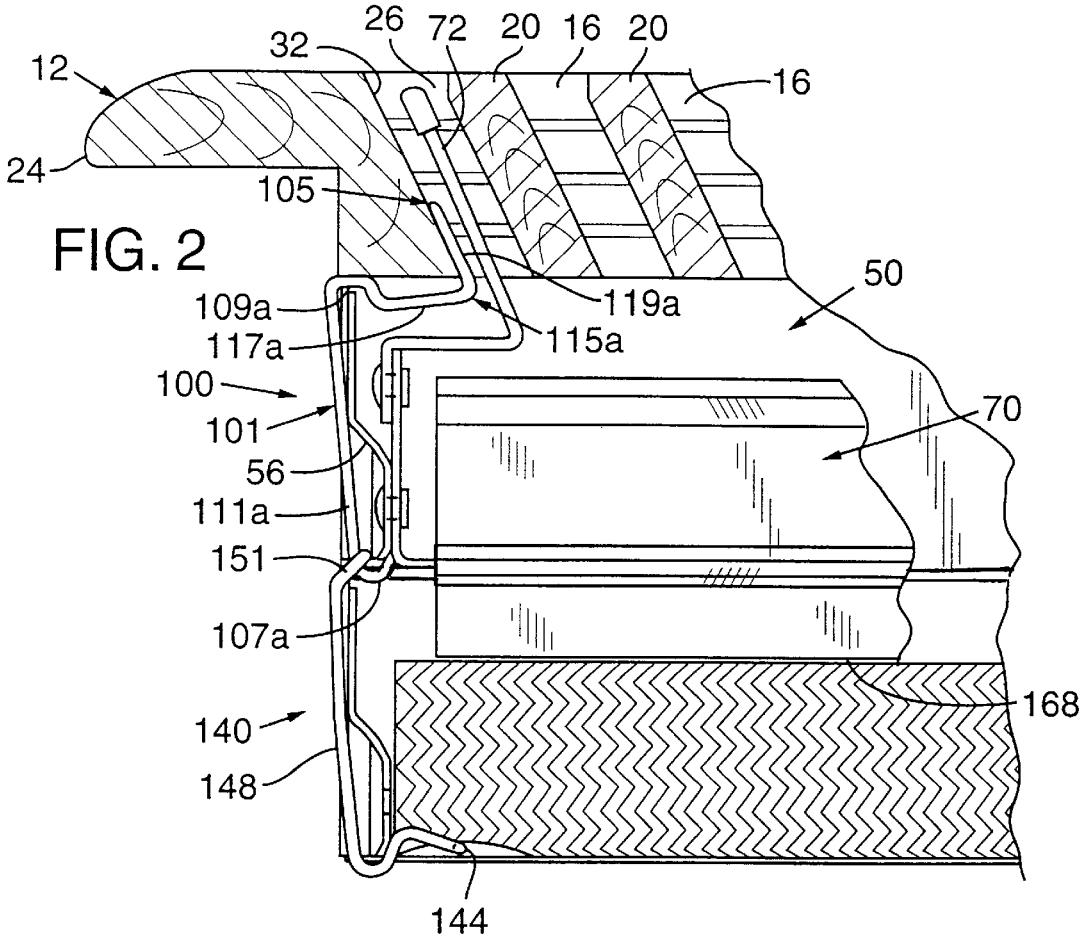
FIG. 2
FIG. 3
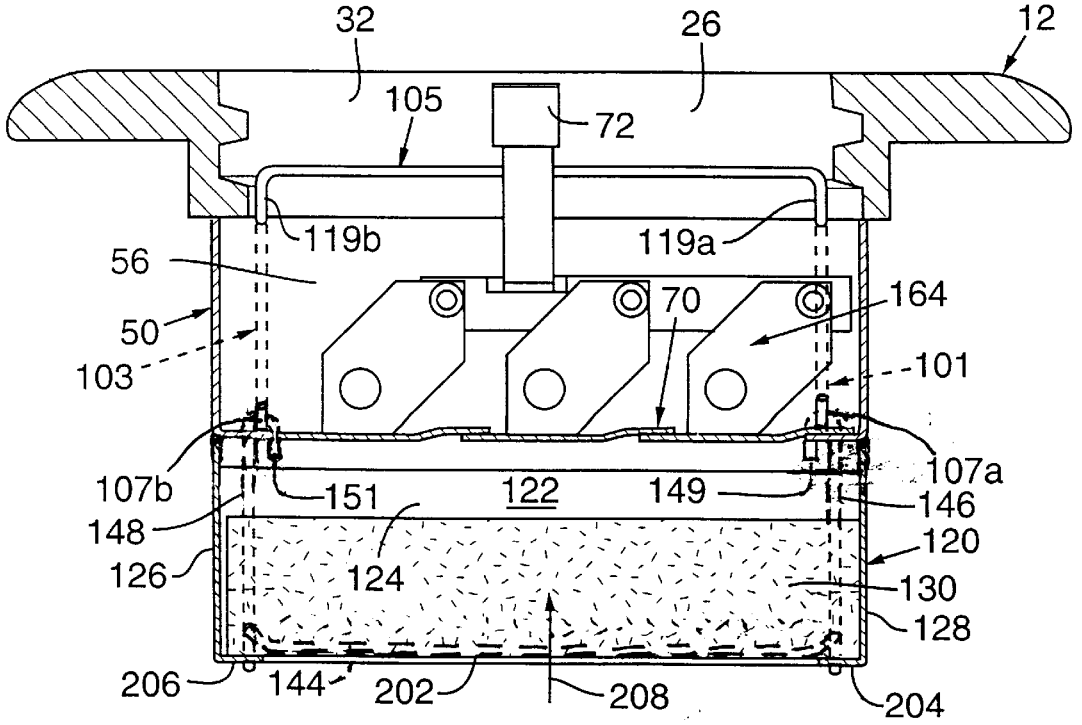

12
34
30
26
32
72
105
100
50
102
240

VENT COUPLER

BACKGROUND

Duct openings in, for example, heating and ventilation systems, are typically covered by a vent cover for aesthetic and functional reasons. In the case of floor ducts, vent covers are also provided for safety reasons to prevent someone from stepping into an otherwise open duct opening. Vent covers typically have a plurality of air flow slots or openings through a central region of the vent cover through which air passes.

A damper is often provided in the duct opening. In some cases, both the vent cover and damper have been made out of metal and are welded together as a unit and mounted in place by positioning the damper in the duct opening. The vent cover, which typically has cross-sectional dimensions greater than those of the duct opening, engages the floor adjacent to the duct opening and prevents the vent cover and damper combination from dropping into the duct opening.

It is also known to make vent covers of wood with a plurality of air flow slots being provided through the wooden vent cover. The slots are defined typically by vanes included in the vent cover. In one common construction, the vanes defining the slots at opposite ends of the vent cover have an upper surface which is angled to extend downwardly and away from the outer ends of the vent cover. Vent covers of this type have been known to be mounted by screws or glue to a damper to form a vent cover damper combination which is then positioned in the duct opening with the vent cover spanning the duct opening and preventing the combination from slipping into the duct.

When screws are utilized to mount the wooden vent cover to the damper, the vent cover can split as the screws are tightened. This adds to the cost as replacement of the vent cover is often required under these circumstances. In addition, if a vent cover is permanently attached to a damper housing, as by glue, it makes it difficult to clean the interior of the damper housing.

A conventional damper includes a rectangular housing with first and second end walls, side walls, and louvers positioned in the bottom of the damper housing. The louvers are mechanically linked to a lever which is accessible through one of the air flow slots to adjust the damper louvers and thereby control the flow of air through the damper housing and vent cover.

SUMMARY

In accordance with one embodiment, a vent assembly is described with a vent cover, a damper with a housing, and with first and second vent cover couplers formed of bent wire and shaped for detachably coupling the vent cover to upper and lower edge portions of walls of the damper. In one approach, the vent cover couplers slidably engage the vent cover and are detachably coupled to the damper and more specifically to end walls of the damper. In one specific form of assembly, (a) screws and other mechanical fasteners of this type are not required; and (b) tools are not required to attach and detach the vent cover from the damper. In a conventional manner, the damper housing may have first and second end walls and side walls. In addition, the vent cover may have a plurality of air passageway slots with a first of the slots being positioned adjacent to a first end of the damper housing and a second of the slots being positioned adjacent to a second end of the damper housing when the vent cover is in a first or installed position overlying the damper. In an illustrated example, the first vent cover coupler includes an elongated cross-piece or latch portion that extends from the damper housing into the first or associated slot when the vent cover is in the first position. In addition, in this example, the second vent cover coupler similarly has an elongated cross-piece or latch portions that extends from the damper housing into the second or associated slot when the vent cover is in the first position. The vent cover couplers may each include first and second leg elements which are spaced apart from one another. The latch portion extends between upper end portions of the first and second leg elements. The leg elements and latch portion of each coupler may be formed of a single continuous piece of wire.

The leg elements resiliently support the cross-piece or latch portion. The leg element portions of at least one of the couplers in one embodiment are flexed in a first direction to permit insertion of latch portions of the first and second vent cover couplers into the associated first and second slots. Such leg element portions move in the second direction opposite the first direction to cause the latch portions to engage the associated slot when no longer flexed. In this case, the latch portions slide into engagement with the associated slot.

The leg element portions may each have a hook element for engaging the lower edge of an associated end wall of the damper and an edge receiving recess defining element which receives the upper edge of the associated end wall. The end wall of the damper is gripped between the hook element and edge receiving recess defining element. An elongated main leg section extends between the hook element and edge receiving recess defining element of each leg. Each leg includes a latch support element extending at least partially inwardly from the upper edge of the damper end wall. The latch portion extends between the latch support elements.

The latch portion of each coupler extends into the associated one of the first and second slots when the vent cover is coupled to the damper housing. In one specific form, the main leg sections of the leg elements of each of the first and second vent cover couplers is positioned at the exterior of the damper housing. In this specific construction, the main leg sections of the leg elements of the first coupler are positioned adjacent to the first end wall of the damper housing and the main leg sections of the leg elements of the second coupler are positioned adjacent to the second end wall of the damper housing. Each of the leg elements may have a latch support element with a first section extending inwardly to position an inner portion of the first section within the interior of the damper housing. In addition, each latch support element may also have a second section extending outwardly toward the exterior of the damper housing from the inner portion of the first section and also extending upwardly toward the vent cover. The second section of each leg element may be configured to cooperate with the latch element or cross-piece to engage the associated one of the first and second vent cover slots when the vent cover is in the first position overlying the damper. More specifically, the vent cover may include air slot bounding surfaces which extend downwardly and inwardly along the outermost boundaries of the respective first and second slots for engagement by the respective second sections and cross-pieces or latch elements of the couplers to detachably couple the damper to the vent cover.

In a specific form, each of the first and second sections of the respective leg elements may have an acute angle provided between the first and second sections. As a specific example, the acute angle may be about seventy degrees.

A filter assembly may be detachably mounted to the damper so as to position the filter at the opposite side of the damper from the vent cover when the vent cover, damper, and filter are positioned in a duct opening. If included, the filter assembly may include a filter housing with a filter positioned therein and may also include first and second filter couplers, which may each be formed of a continuous piece of wire, for detachably coupling the filter housing to the damper housing. In this regard, the filter couplers may detachably and slidably engage the respective first and second vent cover couplers, such as the hook elements thereof, to detachably mount the filter housing in place.

The filter couplers in one form may include the same elements as each of the vent cover couplers.

The illustrated form of couplers are unique and are used for interconnecting components of a vent assembly such as a damper to a vent cover and/or a filter assembly to a damper. Again, in one approach, the couplers are of unitary one-piece construction and are each formed from a single piece of wire.

A housing assembly, such as a damper housing or filter housing, is selectively detachable from another component of a vent assembly (e.g. a vent cover or damper). The housing assembly includes a housing body having an interior and exterior, and also having first and second end wall portions. The housing assembly may include at least one coupler having at least one leg portion, and preferably two spaced apart leg portions, positioned adjacent to a first end portion of the housing body and a latch portion supported by the leg portion. The leg portion in this case may be movable in a first direction relative to the housing body so as to move the latch portion in one direction. The leg portion also may be movable in this case in a second direction opposite to the first direction and relative to the housing so as to move the latch portion in another direction opposite to said one direction. In this case, the latch portion is operable such that, as the latch portion moves in said one direction, the latch portion disengages the vent assembly component and, as the latch portion moves in the second direction, the latch portion engages the vent assembly component. In this manner, the housing assembly is selectively detachable from the component of the vent assembly when the latch portion is moved in said one direction. A similar coupler may be positioned adjacent to the second end portion of the housing body, although a different type of coupling mechanism may be used at such location. The leg elements may be loosely coupled to and detachable from the respective first end portions of the housing body. The latch portion may comprise an elongated wire which is configured to selectively and slidably disengage and engage the component of the vent assembly as the latch portion moves in the respective one and another directions. The leg elements may grip the end walls between first and second end wall edge capturing portions.

The present invention relates to unique and non-obvious features and steps set forth in this disclosure individually as well as to unique and non-obvious combinations thereof.

BRIEF DESCRIPTION OF THE DRAWINGS

FIG. 2 is a partially broken away longitudinal and vertical sectional view of an end portion of the vent assembly of FIG. 1 with the components thereof assembled together.

FIG. 3 is a transverse cross-sectional view of an assembled vent assembly in accordance with FIG. 1.

DESCRIPTION OF ILLUSTRATED EMBODIMENTS

Figure 1:
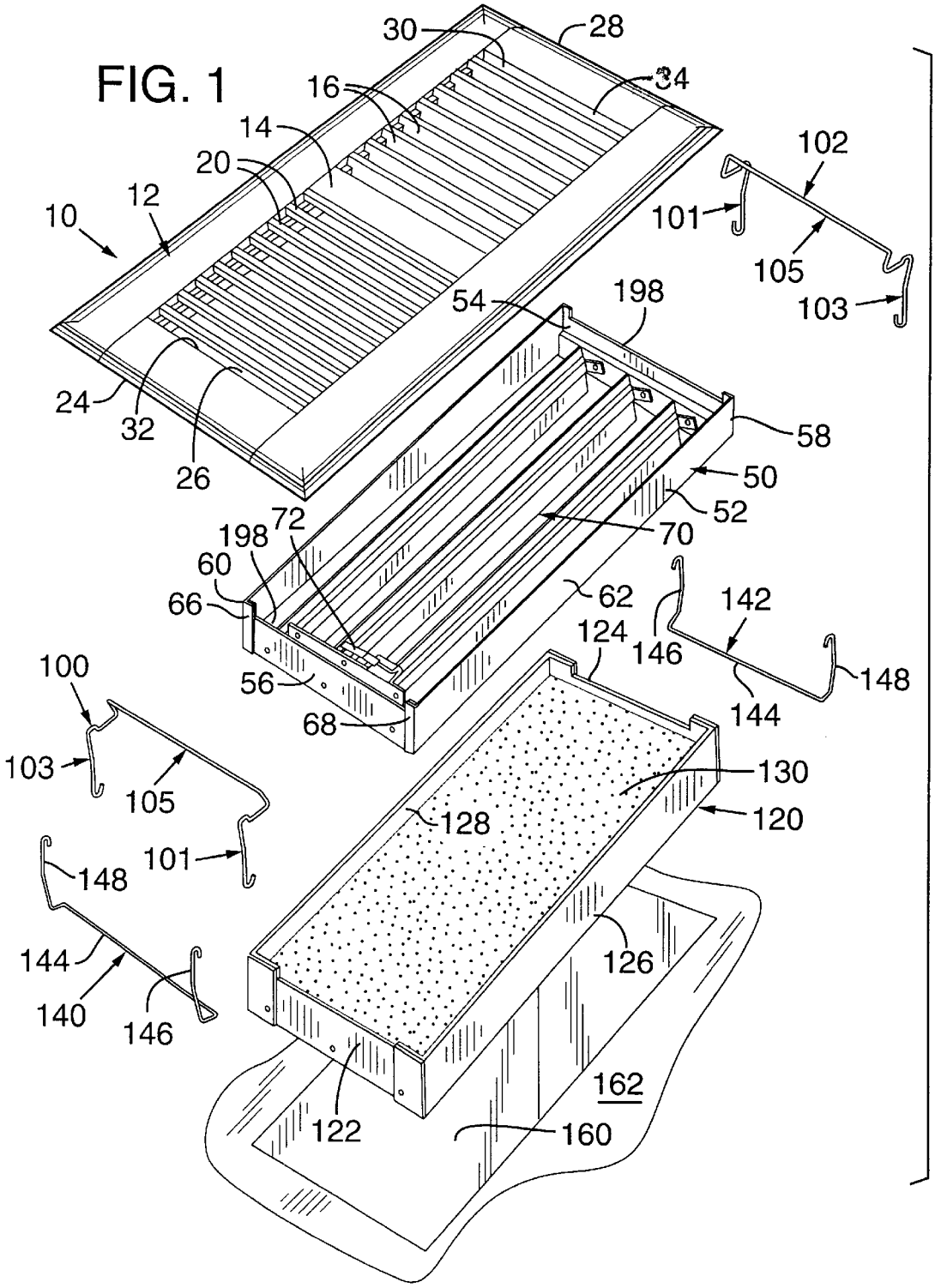
FIG. 1 is an exploded view of one form of a vent cover assembly for installation into a duct opening.

With reference to FIG. 1, one form of vent assembly 10 is shown. The illustrated vent assembly includes a vent cover 12 having an elongated central region 14 through which a plurality of air flow slots, some being indicated at 16, are provided to permit the passage of air through the vent cover. The slots 16 extend transversely relative to the longitudinal axis of the vent cover and are defined by respective air flow deflector vanes, some of which are indicated at 20 in FIG. 1. A first of the slots 16 adjacent to one end portion 24 of the vent cover 12 has been assigned the number 26 in FIG. 1. In addition, a second of the slots 16 adjacent to the opposite end 28 of the vent cover from end 24 has been assigned the number 30. The slot 26 is bounded at one side, its outer side, by a downwardly and inwardly inclined vane surface 32 while the slot 30 is bounded at one side, its outer side, by a downwardly and inwardly inclined surface 34. The illustrated vent cover 12 is preferably of wood, although it may be of any other suitable material such as of metal or plastic. Wooden vent covers of the type illustrated in FIG. 1 are commercially available, such as from Classic Manufacturing NW, LLC., of Portland, Oreg.

The vent assembly 10 also includes a damper 50 which, in the illustrated form, comprises a rectangular, elongated, box-like housing 52 having an interior 54 and an exterior which is outside of the damper housing. The illustrated damper 50 has first and second parallel, spaced-apart, opposed end walls 56, 58. In addition, the damper housing 52 has first and second parallel, spaced apart side walls 60, 62. During manufacture, the illustrated damper 50 has its side walls 60, 62 folded at respective end portions 66, 68 to overlap the end wall 56. The opposite end of the damper housing 52 is similarly constructed. Louvers 70, mechanically linked to a lever 72, are controlled by the lever to adjust the flow of air through the damper 50. When the damper 50 is joined to the vent cover 12, the lever 72 is accessible through one of the slots 16, such as slot 26, so that it may be shifted to open and close the louvers 70. To this point, the description of damper 50 is of a commercially available damper such as from Shoemaker, of Cle Elum, Wash.

Other styles of vent covers and dampers may also be used.

The damper 50 is detachably coupled to the vent cover 12. In accordance with one specific approach, couplers are provided for selectively engaging and disengaging the vent cover to thereby couple the damper housing to the vent cover. More specifically, the couplers may detachably engage the air slots of the vent cover to join the components.

In one specific form, first and second couplers 100, 102 are provided. Although these couplers may be of a different construction from one another, in the illustrated form they are identical. The illustrated coupler 100 includes at least one elongated leg element, and in the illustrated form two spaced apart leg elements 101, 103. An elongated cross-piece or elongated latch element portion 105 extends from the upper end portion of leg element 101 to the upper end portions of leg element 103. The leg elements 101, 103 each include respective wall grippers, which, in the illustrated form, comprises an end wall engager operable to engage upper and lower edge portions of the damper end wall. Alternatively, the upper and lower edges of the side walls may be gripped, but this is a less preferred construction.

Figure 4A:
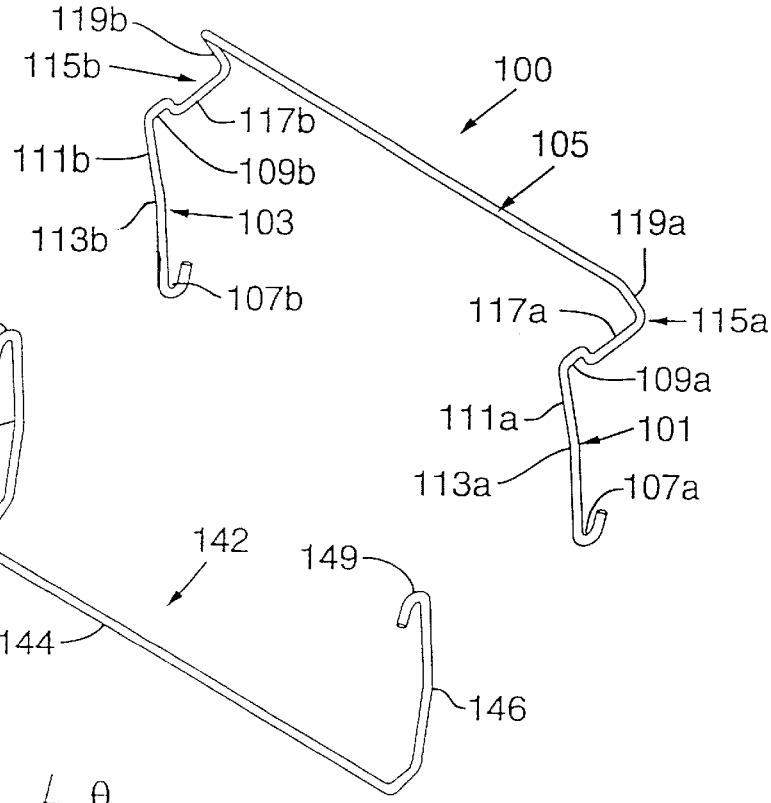
FIGS. 4A–4C are perspective views of several forms of couplers for interconnecting components of the vent assembly of FIG. 1.

In an exemplary form shown in FIG. 4A, leg 101 includes a lower end wall edge engager in the form of an inwardly curved and upwardly opening hook portion 107*a* and an upper end wall edge engager in the form of a downwardly opening edge receiving cup or recess defining portion 109*a*. A main upright elongated leg section 111*a* extends between hook portion 107*a* and recess portion 109*a*. Leg 103 has similar components labeled 107*b*, 109*b* and 111*b* in FIG. 4A. The end wall of the damper housing is, in this case, detachably captured between elements 107*a*, 109*a* and 107*b*, 109*b* to mount the coupler 100 to the damper housing. Thus, the illustrated coupler 100 is sized to snap fit onto the damper housing wall and is easy to use as it may be readily clipped and unclipped from the damper housing.

The leg sections 111*a*, 111*b* are in this form positioned outside of the end wall (e.g., wall 56 in FIG. 1) when mounted in place. The elements 107*a*, 109*a* and 107*b*, 109*b* may be biased to apply a gripping force to the associated end wall. For example, the leg sections 111*a*, 111*b* may be bent inwardly at a central portion (indicated at 113*a*, 113*b* in FIG. 4A). As a result, when the end wall is engaged by the legs 101, 103 the central portions 113*a*, 113*b* bear against the exterior surface of the end walls and, together with elements 107*a*, 109*a* and 107*b*, 109*b* exert a retaining tension to hold the coupler in place on the end wall.

The legs 101, 103 of the coupler 100 also include latch supporting elements 115*a*, 115*b*. Each latch supporting element has respective inwardly extending first section 117*a*, 117*b* and an upwardly and outwardly extending second section 119*a*, 119*b*. Sections 119*a*, 119*b* together with latch portion 105 in the form shown engage the vent cover slot to latch the vent cover to the damper.

The coupler 102 may be identical to coupler 100 and for this reason is not described in detail. Alternatively, the couplers need not be identical to one another.

As can be seen in FIGS. 1 and 4A, the illustrated coupler may be formed from a single piece of wire, for example by bending. Although variable, as a specific example, music wire (type 229) of 0.047 inch diameter may be used with the corners of the bends having a slight radius (e.g., 0.047 inch radius).

One form of a latch portion 105 is supported by the leg elements 101, 103 and, more specifically, is positioned at the upper end portions of the leg elements. As will be described in greater detail below, when this form of coupler 102 is mounted to the damper housing, with legs 101, 103 adjacent to end wall 58 of the damper housing, the latch portion 105 is positioned to engage the vent cover and, more specifically, the surface 34 bounding air flow slot 30. When mounted in place, the upper end portions of legs 101, 103 are spaced from wall 58. As a result, the upper end portions of the legs may be deflected or flexed toward wall 58. This results in latch portion 105 moving in a direction generally toward the damper wall 56 opposite to wall 58. As latch portion 105 moves in this direction, it clears the surface 34, permitting removal of the latch portion downwardly through the slot 30 to decouple the vent cover from the damper housing. After latch portion 105 of coupler 102 is clear of the vent cover 12, the damper housing 50 is typically pivoted about latch portion 105 of coupler 100 through a small arc, freeing the latch portion 105 of the coupler 100 from engagement with the slot 26.

The vent assembly of FIG. 1 may also include an optional filter assembly. The filler assembly may include a filter housing 120 having first and second end walls 122, 124 and side walls 126, 128, which together form a box-like filter housing construction. A filter 130, which may be of a suitable commercially available material, with a polyester or fiberglass pad from Air Filters, Inc., of Houston, Tex., being an example, is supported within housing 120. The illustrated filter housing 120 is most preferably detachably coupled to the damper housing 50 at the opposite side of the damper housing from the vent cover 12. Couplers such as indicated at 140, 142, which may be like couplers 100, 102, or of a different construction as shown in FIG. 1, are mounted to the respective end walls 122, 124 of the filter housing 120 and used to detachably couple the filter housing to the damper.

Figure 4B:
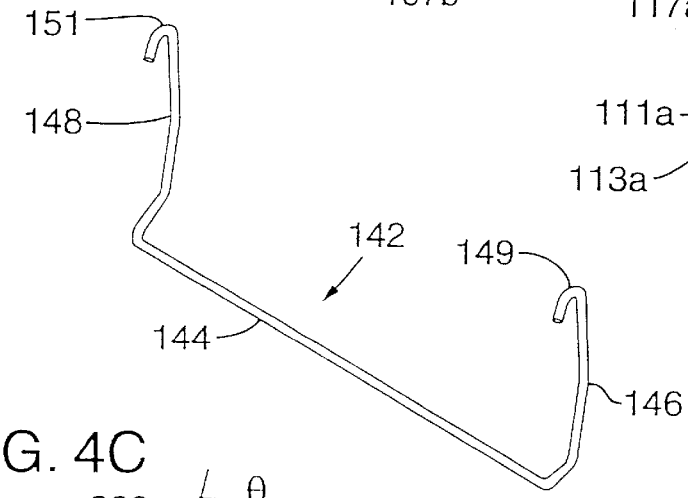

Thus, each of the couplers 140, 142 illustrated in FIG. 1 (see also FIG. 4B) includes a filter supporting base portion 144, at least one upright leg portion, and preferably first and second elongated leg portions 146, 148 extending upwardly from respective ends of the base portion 144. Legs 146, 148 extend inwardly at their lower end portions to position base 144 at an inward location relative to the outer end of the filter housing and relative to the main sections of the legs 146, 148. The upper end portions of legs 146, 148 include an engagement mechanism for coupling to the damper housing. In one form, the engagement mechanism comprise respective inwardly turned and downwardly opening hooks 149, 151 which engage the respective damper coupler or clip 100, 102 positioned above. In FIGS. 2 and 3, hook 151 is shown engaging hook 107*a*. Thus, hangers or clips 140, 142 in the form shown, are detachably coupled to the filter housing and detachably suspend the filter housing from the damper. Couplers 140, 142 may each be made from a single continuous piece of wire which is bent or otherwise formed into the desired shape. The same material may be used for couplers 140, 142 as for couplers 100, 102, although this may be varied. The filter may be detachably coupled to damper housing 50 in other ways. For example, mechanical fasteners, although less preferred, could be used. In addition, hangers may be used to suspend the filter housing from pegs or other projections or slots or engagement mechanisms included in the damper housing. It should be noted that the filter housing and filter assembly may be used in applications where air filtration is desired at the vent outlet 160.

When the assembly is interconnected, the vent cover, damper housing and filter combination may be inserted in a duct opening such as indicated at 160 at FIG. 1. Duct opening 160 is shown as a floor duct opening bounded by a floor 162. The longitudinal and transverse cross-sectional dimensions of vent cover 12 are greater than the longitudinal cross-sectional dimensions of the duct opening 160 so that the assembly does not fall into the duct opening when installed. It is also possible for the assembly to be sized differently. For example, supports may be included in the duct opening to hold the assembly in place in the event the vent cover is made to have cross-sectional dimensions which are smaller than those of the duct opening for recessing into the duct opening.

FIGS. 2 and 3 illustrate the combined components utilized in the vent assembly of FIG. 1. These figures also illustrate a conventional linkage 164 operated by lever 72 to open and close the louvers 70 of the damper 50. In FIG. 2, the louvers are shown in their open position. When open, adequate clearance is provided between the upper surface 166 of the filter 130 and the lower edges, one being indicated at 168 in FIG. 2, of the louvers 70.

In the illustrated construction, spacing is maintained between the upper end of the upright legs of each coupler 100, 102 and the adjacent end wall of the associated housing to facilitate flexing of the upright wall and movement of the associated latch portion. This spacing is, for example, provided by bending the main leg sections 111*a,* 111*b* (FIG. 4A). One or more spacers may alternatively be used for this purpose.

As can be visualized from FIG. 3, by simply hooking the filter housing hooks 149, 151 onto the lower ends of the hooks 107*a,* 107*b* and rotating support 144 into position where it snaps onto and engages a lower edge of an associated respective end wall 122, 124 of the filter housing, the filter couplers 140, 142 support the filter housing. By disengaging supports 144 from the filter housing 120, the filter housing may be removed from the damper housing 50. The filter couplers may be removed by lifting the couplers upwardly to disengage hooks 149, 151 from hooks 107*a,* 107*b*. This makes changing of the filter easy to accomplish.

As also can be seen in the forms shown in FIGS. 1 and 2, the respective legs 102, 103 are spaced closer to one another than the width of the housing 50. This positions the legs so as to clear the end flaps 66, 68 as the legs are moved toward the adjacent housing during attachment and detachment of the housing from the adjoining vent component. In addition, as best seen in FIG. 1 at end wall 56, a notch 198 may be provided in the central portion of the end walls. This notch accommodates the latch portion 105 where it extends inwardly into the interior of the housing. A similar notch may be provided in the end walls 124, 126 of the filter housing. Again, although FIG. 2 illustrates one end portion of the illustrated vent assembly, the opposite end portion of the vent assembly may be the same. The respective walls 122, 124, 126 and 128 of the filter housing 120 typically each have a filter supporting lip along their lower edge, three of which are indicated at 202, 204 and 206 in FIGS. 2 and 3, upon which the filter 130 rests. An opening between the lips, such as indicated by arrow 208 in FIG. 3, allows the free flow of air through the filter. The filter 130, of course, may be supported in any suitable manner.

Figure 4C:
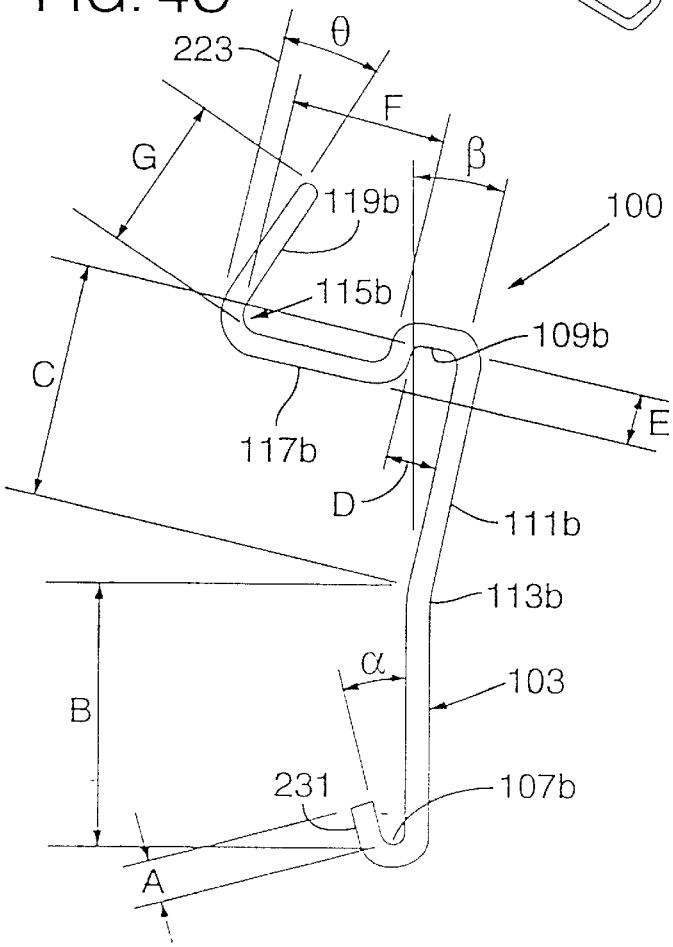

The illustrated form of couplers 100, 102 will next be described in greater detail with reference to coupler 100 shown in FIG. 4C The main leg section (e.g., 111*b*) in the illustrated construction is bent at 113*b*. When the lower section below location 113*b* is oriented in a vertical plane, the upper section (above location 113*b*) in this form is shown bent outwardly from vertical through an acute angle β. In one specific example, β is thirteen degrees. In addition, the tip 231 of hook 107*b* is angled inwardly at an angle relative to vertical. In one specific example, is fifteen degrees. In addition, section 119*b* is angled upwardly and outwardly at an angle θ from a line 223 which is perpendicular to the section 117*b*. In a specific example, θ is twenty degrees. These angles are illustrative and may be varied. Exemplary dimensions of the components of the FIG. 4C construction may be varied. However, a specific example is set forth in the table below for use with a damper of a nominal width of four inches. In this example, the letters identify the location of the specific dimension as depicted in FIG. 4C.

A 0.125 inch

B 0.597 inch

C 0.528 inch

D 0.125 inch

E 0.112 inch

F 0.343 inch

G 0.350 inch

In this example, the width of the coupler was 2.95 inches. Again, the above dimensions are for one specific example of a coupler. These dimensions may be varied and the configuration of the couplers and components thereof, such as the leg elements and latch portions, may also be varied while still selectively engaging the adjacent vent assembly component.

Figures 5A, 5B, 5C:
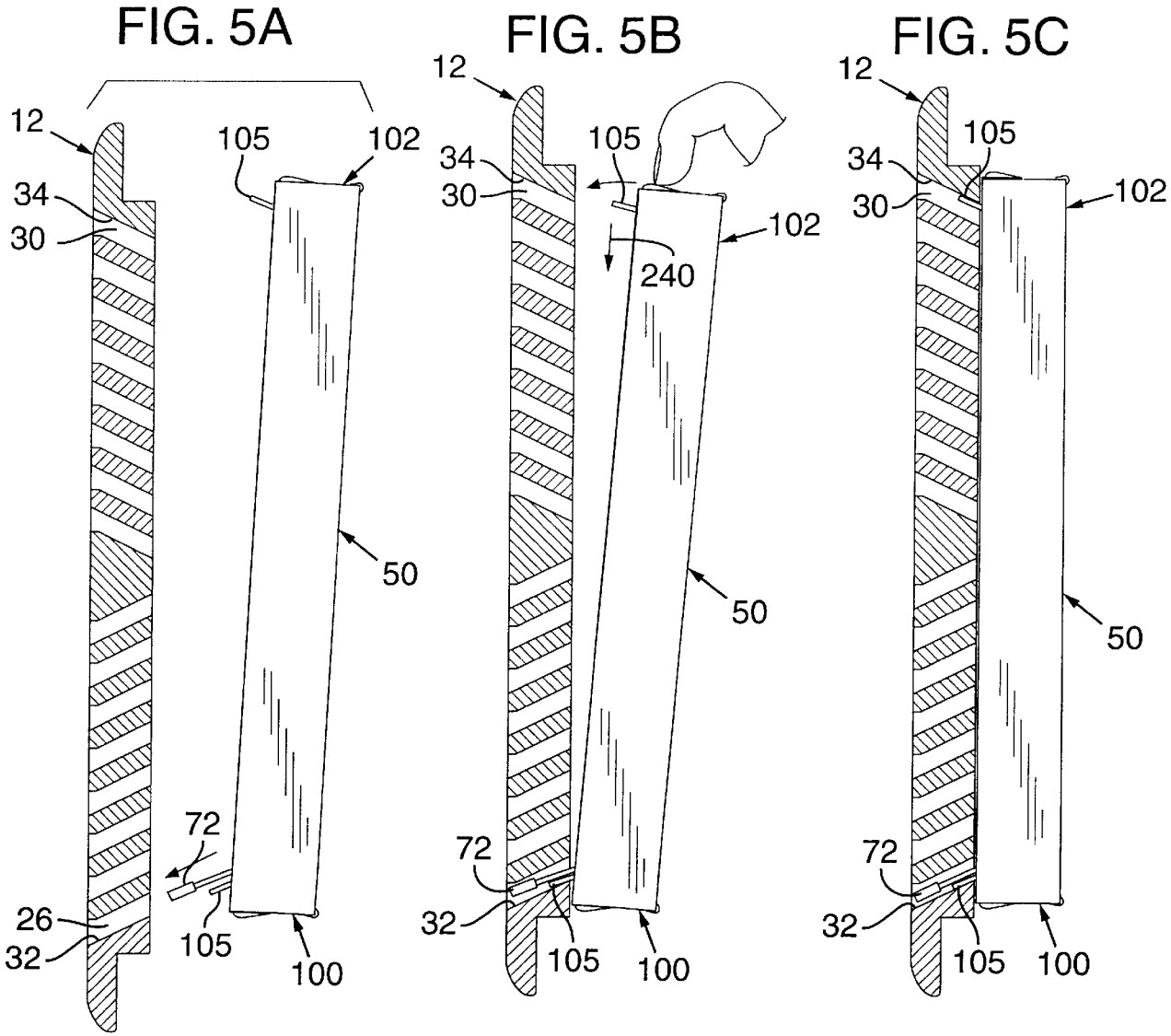
FIGS. 5A, 5B and 5C schematically illustrate a method of detachably interconnecting a damper of a vent cover assembly to a vent cover of the assembly utilizing couplers of the form shown in FIG. 4A.

The method of assembling a vent cover and damper housing utilizing the couplers of the form illustrated in FIG. 1 will be readily apparent from FIGS. 5A, 5B, and 5C.

With reference to FIG. 5A, the louver control lever 72 is inserted into the slot 26. At the same time, coupler section 105 of the coupler 100 is also positioned within this slot. The vent cover 12 and damper housing 50 are pivoted away from one another slightly to facilitate the positioning of latch portion 105 of coupler 100 and the louver control 72 into the slot 26. FIG. 5B illustrates the state of the vent assembly when this first step has been accomplished. At this time, the legs of coupler 102 are flexed to shift latch section 105 of coupler 102 in the direction indicated by arrow 240. This permits the section 105 of coupler 102 to be inserted into the slot 30 by pivoting the vent cover 12 into the position shown in FIG. 5C with the vent cover overlying and abutting the damper housing 50. When pressure is released on coupler 102, the latch section 105 of this coupler travels in a direction opposite to the direction 240 and into engagement with the surface 34 bounding the slot 30. In this manner, the vent cover 12 is coupled to the damper housing 50. These steps may be reversed to detach the damper housing from the vent cover. As an advantage to this specific approach, no tools are needed to install or remove the vent cover from the damper housing. In this approach, the vent engaging portion of coupler 100 may be rigid (e.g. latch 105 being immovable) with all of the flexing being accomplished by the coupler 102.

The illustrated couplers are economical to produce and install. Conventional dampers may be used, although in the preferred approach the conventional dampers may be modified to provide a notch (e.g. 198 in FIG. 1) in the end wall of the damper to accommodate the latch portion of the illustrated coupler.

Having illustrated and described the principles of my invention with respect to illustrated embodiments, it should be apparent to those of ordinary skill in the art that my invention may be modified in arrangement and detail without departing from these principles. For example, although advantages exist for the illustrated form of coupler, the coupler may be configured to detachably engage the end walls of the damper at other than the upper and lower edge portions thereof. In addition, although less preferred, the couplers may be made of plural interconnected components and need not be formed of a single piece of wire. I claim all such modifications and arrangements which fall within the scope of the following claims:

I claim:

1. A vent assembly for a duct opening comprising:

a damper having a housing with first and second end walls, each end wall having an upper and lower edge portion;

a vent cover having a plurality of air passageway slots through which air passes through the vent cover, a first of such slots being positioned adjacent to the first end of the damper housing and a second of such slots being positioned adjacent to the second end of the damper housing when the vent cover is in a first position overlying the damper;

a first vent cover coupler having a first end wall edge engager which engages the upper and lower edge portions of the first end wall and a first latch portion extending from the damper housing into the first slot when the vent cover is in the first position, with the first vent cover thereby being associated with the first slot, a second vent cover coupler having a second end wall edge engager which engages the upper and lower edge portions of the second end wall and a second latch portion extending from the damper housing into the second slot when the vent cover is in the first position, with the second vent cover coupler thereby being associated with the second slot, the first and second vent cover couplers thereby coupling the damper housing to the vent cover when the vent cover is in the first position, at least one of the first and second vent cover couplers comprising a resilient element which is flexed in a first direction to permit insertion of the first and second vent cover couplers into the associated first and second slots, the resilient element moving in a second direction opposite to the first direction and into engagement with the associated slot when no longer flexed.

2. A vent assembly according to claim 1 wherein each of the first and second vent couplers are formed from a single continuous piece of wire.

3. A vent assembly according to claim 1 wherein the first end wall edge engager is sized to snap fit onto the first end wall and wherein the second end wall edge engager is sized to snap fit onto the second end wall.

4. A vent assembly according to claim 1 wherein the first coupler includes first and second spaced apart upright elongated legs and the first latch portion extends between the first and second legs of the first coupler, each of the first and second legs of the first coupler including an upwardly opening lower hook positioned to receive the lower edge portion of the first end wall on the hook and an upper recess defining portion which defines a downwardly opening recess spaced from the hook, the downwardly opening recess being positioned to receive the upper edge portion of the first end wall, each of the first and second legs of the first coupler also including a central leg section extending from the hook to the recess defining portion; and wherein the second coupler includes first and second spaced apart upright elongated legs and the second latch portion extends between the first and second legs of the second coupler, each of the first and second legs of the second coupler including an upwardly opening lower hook positioned to receive the lower edge portion of the second end wall on the hook and an upper recess defining portion which defines a downwardly opening recess spaced from the hook, the downwardly opening recess being positioned to receive the upper edge portion of the second end wall, each of the first and second legs of the second coupler also including a central leg section extending from the hook to the recess defining portion.

5. A vent assembly according to claim 4 wherein the damper housing has an exterior and an interior, and wherein the central leg sections of the first and second couplers are each positioned at the exterior of the damper housing adjacent to a respective end wall, and wherein each central leg section has an upper end portion which extends away from the exterior surface of the adjacent end wall.

6. A vent assembly according to claim 5 wherein each leg includes a latch supporting portion having a first section which extends inwardly from the recess defining portion to a location inwardly of the end wall to which the coupler including the leg is mounted, the latch supporting portion also including a second section extending upwardly and outwardly from the first location, the latch portion comprising a cross-piece extending between the second sections of the first and second legs of the coupler which includes the latch portion.

7. A vent assembly according to claim 6 wherein each of the first and second couplers is formed of a respective single continuous piece of wire.

8. A vent assembly according to claim 6 including a filter supported by first and second filter supports which are detachably mounted to the first and second couplers so as to position the filter at the opposite side of the damper from the vent cover when the vent cover, damper and filter are positioned in the duct opening, wherein the first filter support includes a lower filter support portion and first and second upright filter support legs detachably coupled to the first coupler, and wherein the second filter support includes a lower filter support portion and first and second legs detachably coupled to the second coupler.

9. A vent assembly according to claim 8 wherein the filter support legs each include a hook portion positioned to engage a respective one of the first and second coupler legs.

10. A vent assembly according to claim 9 wherein each filter support is formed of a respective single continuous piece of wire.

11. A vent assembly according to claim 1 including a filter supported by first and second filter supports which are detachably mounted to the first and second couplers so as to position the filter at the opposite side of the damper from the vent cover when the vent cover, damper and filter are positioned in the duct opening, the first filter support including a lower filter support portion and first and second upright filter support legs detachably coupled to the first coupler and the second filter support including a lower filter support portion and first and second legs detachably coupled to the second coupler.

12. A vent assembly according to claim 1 including a filter housing and a filter contained within the filter housing, the vent assembly including first and second filter couplers mounted to the filter housing with each filter coupler detachably engaging a respective one of the first and second vent cover couplers to detachably mount the filter housing to the damper housing with the filter at the opposite side of the damper from the vent cover, each filter coupler being formed of a single continuous piece of wire.

13. A vent assembly according to claim 1 wherein the first and second couplers are generally of an inverted U-shape and the first and second filter supports are generally U-shaped.

14. A coupler for interconnecting a vent cover having vent slots to a damper housing having at least one wall with upper and lower edge portions, the coupler comprising:

a body having first and second spaced apart upright elongated legs and a first latch portion extending between the first and second legs, each of the first and second legs including an upwardly opening lower hook positioned to receive the lower edge portion of the at least one wall on the hook and an upper recess defining portion which defines a downwardly opening recess spaced from the hook, the downwardly opening recess being positioned to receive the upper edge portion of the at least one wall, each of the first and second legs also including a leg section extending from the hook to the recess defining portion; and the latch portion being sized for insertion into one of the vent slots to engage the vent cover.

15. A vent assembly according to claim 14 wherein the damper housing has an exterior and an interior, and wherein the legs are each positioned at the exterior of the damper housing, and wherein each leg has an upper end portion which extends away from the exterior surface of said at least one wall where the coupler is mounted to said at least one wall.

16. A vent assembly according to claim 15 wherein each leg includes a latch supporting portion having a first section which extends inwardly from the recess defining portions to a location inwardly of said at least one wall to which the coupler including the leg is mounted and a second section extending upwardly and outwardly from the first location, the latch portion comprising a cross-piece extending between respective second sections of the first and second legs.

17. A vent assembly according to claim 16 wherein the coupler is formed of a respective single continuous piece of wire.

18. A vent assembly for a duct opening comprising:

a damper having a housing with first and second end walls, each end wall having an upper and lower edge portion;

a vent cover having a plurality of air passageway slots through which air passes through the vent cover, a first of such slots being positioned adjacent to the first end of the damper housing and a second of such slots being positioned adjacent to the second end of the damper housing when the vent cover is in a first position overlying the damper;

a first vent cover coupler having a first end wall edge engager which engages the upper and lower edge portions of the first end wall and a first latch portion extending from the damper housing into the first slot when the vent cover is in the first position, with the first vent cover thereby being associated with the first slot, a second vent cover coupler having a second end wall edge engager which engages the upper and lower edge portions of the second end wall and a second latch portion extending from the damper housing into the second slot when the vent cover is in the first position, with the second vent cover coupler thereby being associated with the second slot, the first and second vent cover couplers thereby coupling the damper housing to the vent cover when the vent cover is in the first position, at least one of the first and second vent cover couplers comprising a resilient element which is flexed in a first direction to permit insertion of the first and second vent cover couplers into the associated first and second slots, the resilient element moving in a second direction opposite to the first direction and into engagement with the associated slot when no longer flexed;

each of the first and second vent couplers being formed from a single continuous piece of wire;

the first end wall edge engager being sized to snap fit onto the first end wall and the second end wall edge engager being sized to snap fit onto the second end wall;

the first coupler including first and second spaced apart upright elongated legs and the first latch portion extending between the first and second legs of the first coupler, each of the first and second legs of the first coupler including an upwardly opening lower hook positioned to receive the lower edge portion of the first end wall on the hook and an upper recess defining portion which defines a downwardly opening recess spaced from the hook, the downwardly opening recess being positioned to receive the upper edge portion of the first end wall, each of the first and second legs of the first coupler also including a central leg section extending from the hook to the recess defining portion;

the second coupler including first and second spaced apart upright elongated legs and the second latch portion extending between the first and second legs of the second coupler, each of the first and second legs of the second coupler including an upwardly opening lower hook positioned to receive the lower edge portion of the second end wall on the hook and an upper recess defining portion which defines a downwardly opening recess spaced from the hook, the downwardly opening recess being positioned to receive the upper edge portion of the second end wall, each of the first and second legs of the second coupler also including a central leg section extending from the hook to the recess defining portion;

wherein the damper housing has an exterior and an interior and wherein the central leg sections of the first and second couplers are each positioned at the exterior of the damper housing, each central leg section having an upper end portion which extends away from the exterior surface of the end wail to which the respective coupler containing the central leg section is mounted, and wherein each leg includes a latch supporting portion having a first section which extends inwardly from the recess defining portion of the leg to a location inwardly of the end wall to which the coupler including the leg is mounted and a second section extending upwardly and outwardly from the first location, the latch portion comprising a cross—piece extending between the second sections of the first and second legs of the coupler which includes the latch portion.

19. A vent assembly according to claim 18 comprising:

a filter supported by first and second filter supports which are detachably mounted to the first and second couplers so as to position the filter at the opposite side of the damper from the vent cover when the vent cover, damper and filter are positioned in the duct opening, the first filter support including a lower filter support portion and first and second upright filter support legs detachably coupled to the first coupler and the second filter support including a lower filter support portion and first and second legs detachably coupled to the second filter coupler;

wherein the filter support legs each include a hook portion positioned to engage a respective one of the first and second coupler legs; and wherein each filter support is formed of a respective single continuous piece of wire.

20. A vent assembly for a duct opening comprising:

a vent cover with at least first and second spaced-apart air flow slots;

a damper housing; and a damper clip means formed of wire for detachably coupling the damper housing to the vent cover.

21. A vent assembly according to claim 20 including a filter housing and means formed of wire for detachably coupling the filter housing to the damper housing.

22. A clip for detachably coupling a damper housing to a slot of a vent cover the damper housing having at least one end wall, the clip comprising:

an elongated body having an end wall engaging portion sized for mounting to the upper and lower edge portions of the damper housing end wall, the body also including a latch portion for insertion into the slot of the vent cover to thereby couple the clip to the damper housing and to the vent cover.

23. A clip according to claim 22 in which the body is formed of a single continuous piece of wire.

* * * * *

UNITED STATES PATENT AND TRADEMARK OFFICE

CERTIFICATE OF CORRECTION

PATENT NO. : 6,227,962 B1
DATED : May 8, 2001
INVENTOR(S) : Gary R. Orendorff

It is certified that error appears in the above-identified patent and that said Letters Patent is hereby corrected as shown below:

Column 7,
Lines 44-45, the phrase "angle relative" should be -- angle $\propto$ relative --
Line 45, the phrase "example, is" should be -- example, $\propto$ is --

Signed and Sealed this

Fourth Day of June, 2002

*Attest:*

*Attesting Officer*

JAMES E. ROGAN
*Director of the United States Patent and Trademark Office*